US006389969B1

(12) United States Patent
Kerr

(10) Patent No.: US 6,389,969 B1
(45) Date of Patent: May 21, 2002

(54) PRINT ENGINE CHASSIS HAVING ADJUSTABLE SIDEWALL THICKNESS

(75) Inventor: Roger S. Kerr, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/499,813

(22) Filed: Feb. 8, 2000

(51) Int. Cl.[7] ..... B41F 27/00
(52) U.S. Cl. ..... 101/382.1; 400/691
(58) Field of Search ..... 101/381.2, 383, 101/384, 389, 391, 392; 400/691, 692, 693.1, 694

(56) References Cited

U.S. PATENT DOCUMENTS 3,887,057 A * 6/1975 Stahl et al. ..... 197/186 B
4,446,790 A * 5/1984 Konkel et al. ..... 101/93.14
4,591,284 A * 5/1986 Lim et al. ..... 400/691
4,846,595 A * 7/1989 Kato et al. ..... 400/320
4,883,376 A * 11/1989 Iwase et al. ..... 400/83
4,944,621 A * 7/1990 Uecker ..... 400/691
5,026,186 A * 6/1991 Hasegawa et al. ..... 400/691
5,268,708 A 12/1993 Harshbarger et al.
5,366,306 A * 11/1994 Mizutani et al. ..... 400/694
5,775,825 A * 7/1998 Hong et al. ..... 400/693
6,024,506 A * 2/2000 Eum et al. ..... 400/691
6,120,201 A * 9/2000 McKay et al. ..... 400/691
6,208,818 B1 * 3/2001 Noda ..... 399/111

* cited by examiner

*Primary Examiner*—John S. Hilten
*Assistant Examiner*—Darius N. Cone
(74) *Attorney, Agent, or Firm*—Nelson Adrian Blish

(57) ABSTRACT

According to one aspect of the present invention, a print engine chassis for supporting an imaging drum (14), an imaging drum motor (16), and a printhead translation assembly (40), and translation motor (18), comprises a sheet metal frame (12) comprised of a plurality of interlocking rigid members. The interlocking rigid members form a first and a second sidewall (23, 25) disposed on opposite ends of the imaging drum (14). A thickness of the first sidewall (23) is adjustable and a thickness of the second sidewall (25) is adjustable to allow the thickness of each sidewall to be varied to accommodate either a right-to-left or a left-to-right imaging direction.

4 Claims, 4 Drawing Sheets

PRINT ENGINE CHASSIS HAVING ADJUSTABLE SIDEWALL THICKNESS

FIELD OF THE INVENTION

This invention relates to printers in general and more particularly to a print engine chassis having adjustable side walls to allow mounting motor components on either side of the chassis.

BACKGROUND OF THE INVENTION

Pre-press color proofing is a procedure used by the printing industry to create representative images of printed material. This procedure avoids the high cost and time required to produce printing plates and set-up a high-speed, high-volume printing press to produce a single intended image for proofing prior to a production run of the intended image. In the absence of pre-press proofing, a production run may require several corrections to the intended image to satisfy customer requirements, and each of the intended images would require a new set of printing plates. By utilizing pre-press color proofing, time and money are saved.

A laser thermal printer having half-tone color proofing capabilities is disclosed in commonly assigned U.S. Pat. No. 5,268,708 titled "Laser Thermal Printer With An Automatic Material Supply," issued Dec. 7, 1993 in the name of R. Jack Harshbarger, et al. The Harshbarger, et al. device is capable of forming an image on a sheet of thermal print media by transferring dye from a roll of dye donor material to the thermal print media. This is achieved by applying thermal energy to the dye donor material to form an image on the thermal print media. This apparatus generally comprises a material supply assembly; a lathe bed scanning subsystem, which includes a lathe bed scanning frame, a translation drive, a translation stage member, a laser printhead, and a rotatable vacuum imaging drum; and exit transports for the thermal print media and dye donor material.

The operation of the Harshbarger, et al. apparatus comprises metering a length of the thermal print media in roll form from a material supply assembly. The thermal print media is measured and cut into sheet form of the required length, transported to the vacuum imaging drum, registered, and wrapped around and secured to the vacuum imaging drum. A length of dye donor roll material is metered out of the material supply assembly, measured, and cut into sheets of the required length. The cut sheet of dye donor roll material is then transported to and wrapped around the vacuum imaging drum, and superposed in registration with the thermal print media. The scanning subsystem traverses the printhead axially along the rotating vacuum imaging drum in to produce the image on the thermal print media. The image is written in a single swath, traced out in the pattern of a continuous spiral, concentric with the imaging drum, as the printhead is moved in parallel to the drum axis.

Although the printer disclosed in the Harshbarger, et al. patent performs well, there is a long-felt need to reduce manufacturing costs for this type of printer and for similar types of imaging apparatus. With respect to the lathe bed scanning frame disclosed in the Harshbarger, et al. patent, the machined casting used as the frame represents significant cost relative to the overall cost of the printer. Cost factors include the design and fabrication of the molds, the casting operation, and subsequent machining needed in order to achieve the precision necessary for a lathe bed scanning engine used in a printer of this type. Castings present inherent problems in modeling, making it difficult to use tools such as finite element analysis to predict the suitability of a design. Moreover, due to shrinkage, porosity, and other manufacturing anomalies, it is difficult to obtain uniform results when casting multiple frames. In the assembly operation, each frame casting must be individually assessed for its suitability to manufacturing standards and must be individually machined. Further, castings also exhibit frequency response behavior, such as to resonant frequencies, which are difficult to analyze or predict. For this reason, the task of identifying and reducing vibration effects can require considerable work and experimentation. Additionally, the overall amount of time required between completion of a design and delivery of a prototype casting can be several weeks or months.

Alternative methods used for frame fabrication have been tried, with some success. For example, welded frame structures have been used. However, these welded structures require skilled welding and significant expense in manufacture. Whether using a casting or weldment, the design of the print engine is optimized for imaging with the printhead moving either from left to right along the leadscrew or from right to left. Drive motors are appropriately positioned on one side of the print engine frame or the other. The side walls of the print engine frame that provides support for these drive motors have dimensions which this support function. The side wall of the print engine frame that does not support motor mounts is correspondingly less massive than the opposite side wall.

It would be useful to provide a print engine chassis design that, with only minor variations in assembly practices, allows the writing direction for a printer to be reversed, without requiring redesign of the drive system, translation assembly, and lead screw.

SUMMARY OF THE INVENTION

An object of the present invention is to provide a sheet metal structure for a print engine chassis that can be configured for either a left-to-right or a right-to-left imaging path.

According to one aspect of the present invention, a print engine chassis for supporting an imaging drum, an imaging drum motor, and a printhead translation assembly, and translation motor, comprises a sheet metal frame comprised of a plurality of interlocking rigid members. The interlocking rigid members form a first and a second side wall disposed on opposite ends of the imaging drum. A thickness of the first sidewall is adjustable and a thickness of the second side walls is adjustable to allow the thickness of each sidewall to be varied to accommodate either a right-to-left or a left-to-right imaging direction.

According to an embodiment of the present invention, sheet metal pieces are cut to form interlocking rigid members, which have tabs and slots that allow the interlocking rigid members to be quickly assembled by hand in order to form the sheet of the chassis. Alternate tabs and slots are provided to permit multiple configurations of side-wall thickness.

A feature of the present invention is a method of manufacturing a chassis that can be easily assembled, but is at the same time structurally rigid and a suitable replacement for a metal casting or weldment.

An advantage of the present invention is that individual interlocking rigid members can be modified in order to change the design of the chassis, and modify the size or configuration of the overall structure. This contrasts with methods using a casting, which cannot be easily modified or scaled dimensionally.

Another advantage of the present invention is cost savings, since a small number of parts serves multiple printer configurations. The present invention allows the same print engine chassis design to be used, with minor variations in assembly methods, to accommodate a printhead assembly that writes either from right to left, or from left to right along a lead screw translation system. The present invention provides a chassis that is structurally rigid, economical, and can be easily modified.

These and other objects, features, and advantages of the present invention will become apparent to those skilled in the art upon a reading of the following detailed description when taken in conjunction with the drawings, wherein there is shown and described illustrative embodiments of the invention.

The invention and its objects and advantages will become more apparent in the detailed description of the preferred embodiment presented below.

BRIEF DESCRIPTION OF THE DRAWINGS

While the specification concludes with claims particularly pointing-out and distinctly claiming the subject matter of the present invention, the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the invention. It is to be understood that elements not specifically shown or described may take various forms well known to those skilled in the art.

Figure 1:
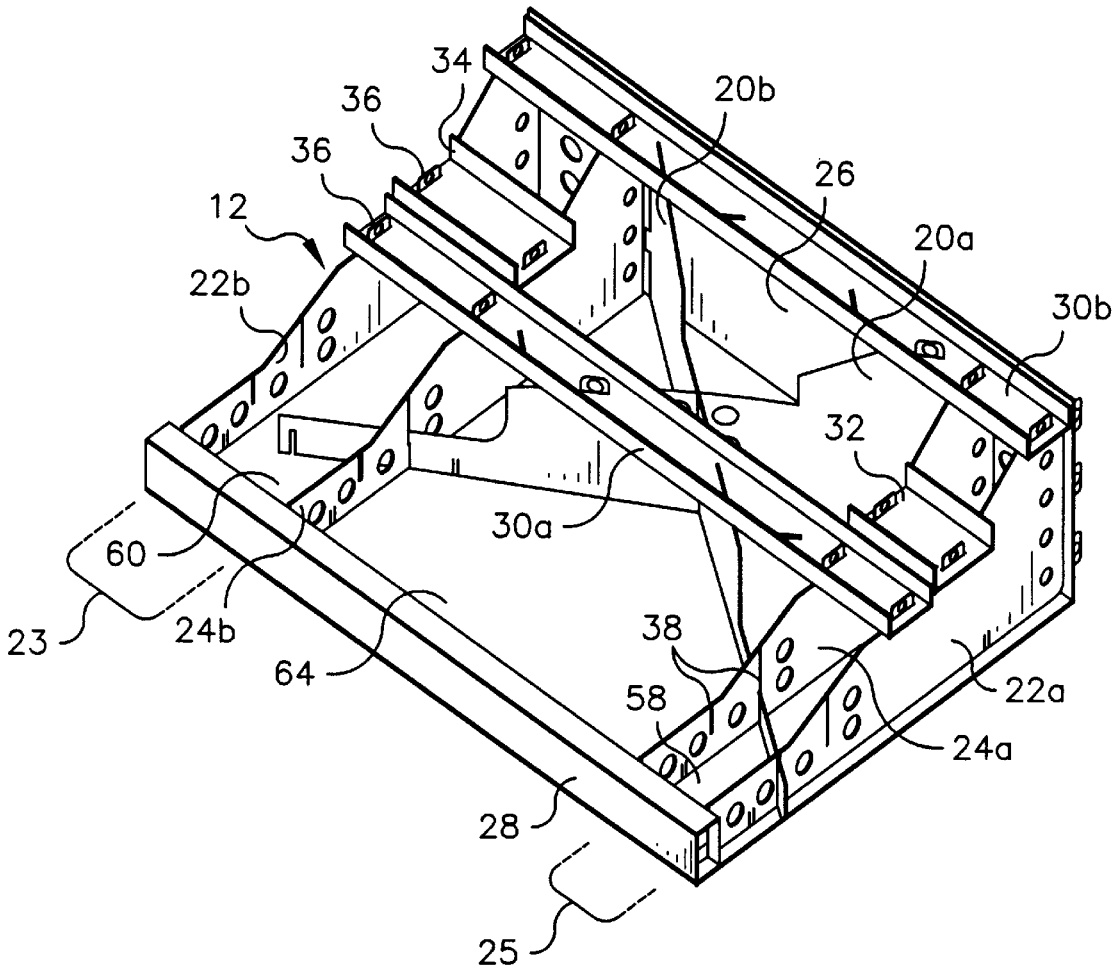
FIG. 1 is a perspective view of a sheet metal frame for a print engine chassis according to a preferred embodiment of the invention.

Referring to FIG. 1, there is shown a sheet metal frame 12 for a print engine chassis. In the preferred embodiment, sheet steel of 0.090 inch nominal thickness is used to provide sufficient strength. Sheet steel members can be cut from stock using laser cutting techniques, well known in the sheet metal art.

Sheet metal frame 12 is comprised of outer walls 22*a* and 22*b*, interior walls 24*a* and 24*b*, a rear wall 26, and a front member 28 mounted on a base 64. Sheet metal frame 12 further comprises supporting and bracing structures provided by full-length cross-struts 30*a* and 30*b* and cross braces 20*a* and 20*b*. A narrow wall cross-strut 34 spans outer wall 22*b* and interior wall 24*b* to form a sidewall 25 with a narrow dimension, as indicated by B in FIG. 2. A wide wall cross-strut 32 spans between outer wall 22*a* and interior wall 24*a* to form a sidewall 23 with a thicker dimension, as indicated by A in FIG. 2.

Referring again to FIGS. 1 and 2, sheet metal structures that form sheet metal frame 12 are joined using slot-and-tab construction. At each junction of sheet metal members, a slot 38 is provided. In this arrangement, slot 38 mates with a corresponding slot 38 on a joining member, or slot 38 is fitted to a tab 36. Cross-brace slots 38*a* are widened to seat tabs 36 from cross braces 20*a* and 20*b*.

Figure 2:
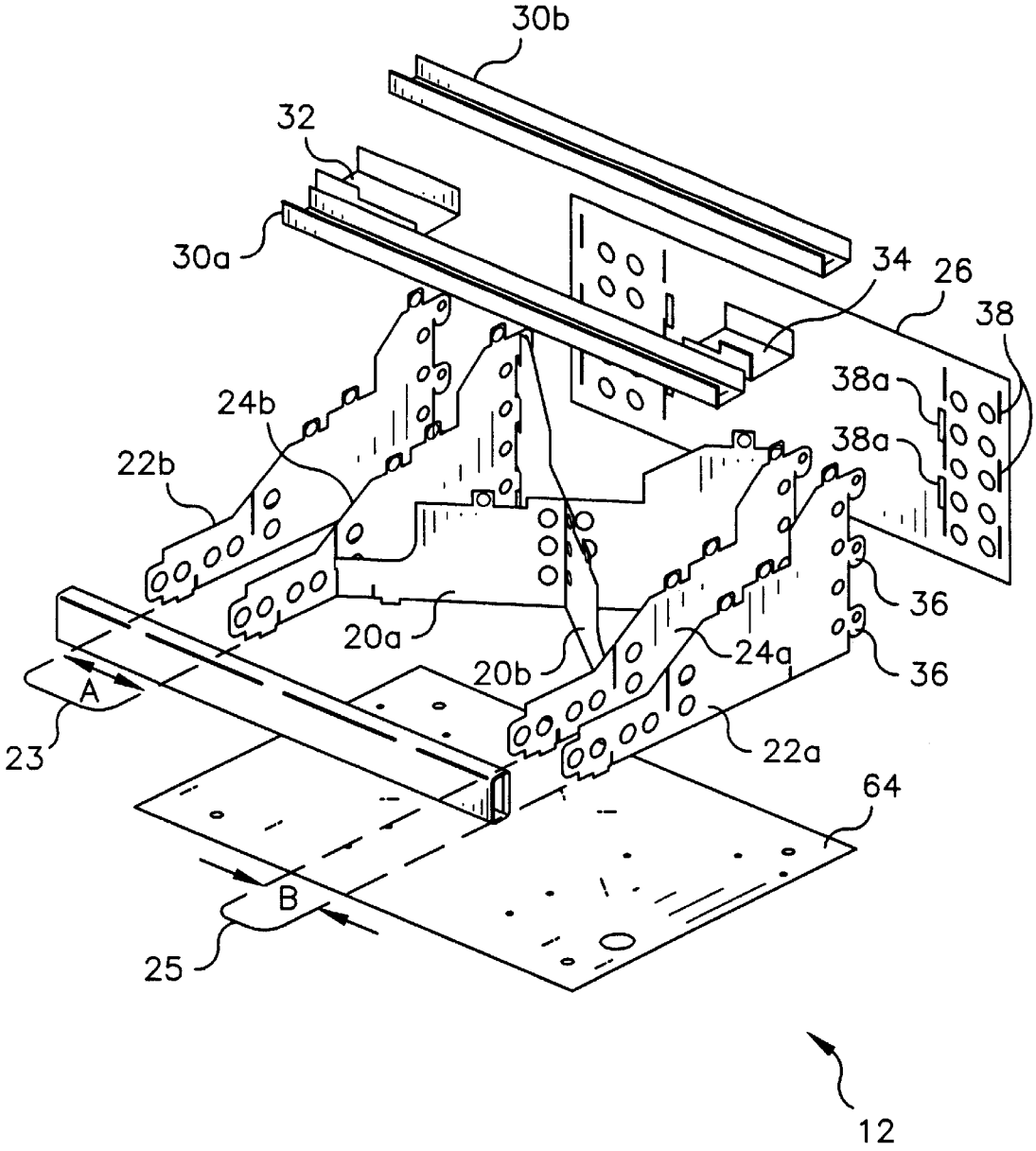
FIG. 2 is an exploded, perspective view of a sheet metal frame for a print engine chassis assembled without fasteners, optimized for writing from left to right.

Using an arrangement of sheet metal members configured as is shown in FIGS. 1 and 2, it can be seen that a design can be implemented that allows re-use of the same members for different print engine configurations. For example, interior wall 24*a* could be disposed further to the right within sheet metal frame 12. This might be preferable, for example, where the weight of supported motor structures requires additional support. By cutting additional slots into front member 28, cross braces 20*a* and 20*b*, and rear wall 26, interior wall 24*b* could be suitably repositioned in a number of different locations, at different distances from outer wall 22*b*. Alternately, the overall dimensions of sheet metal frame 12 could be altered while using many of the same sheet metal members. For example, the length of a chassis frame could be changed simply by altering the lengths of full-length cross struts 30*a* and 30*b*, front member 28, base 64, and rear wall 26.

Figure 3:
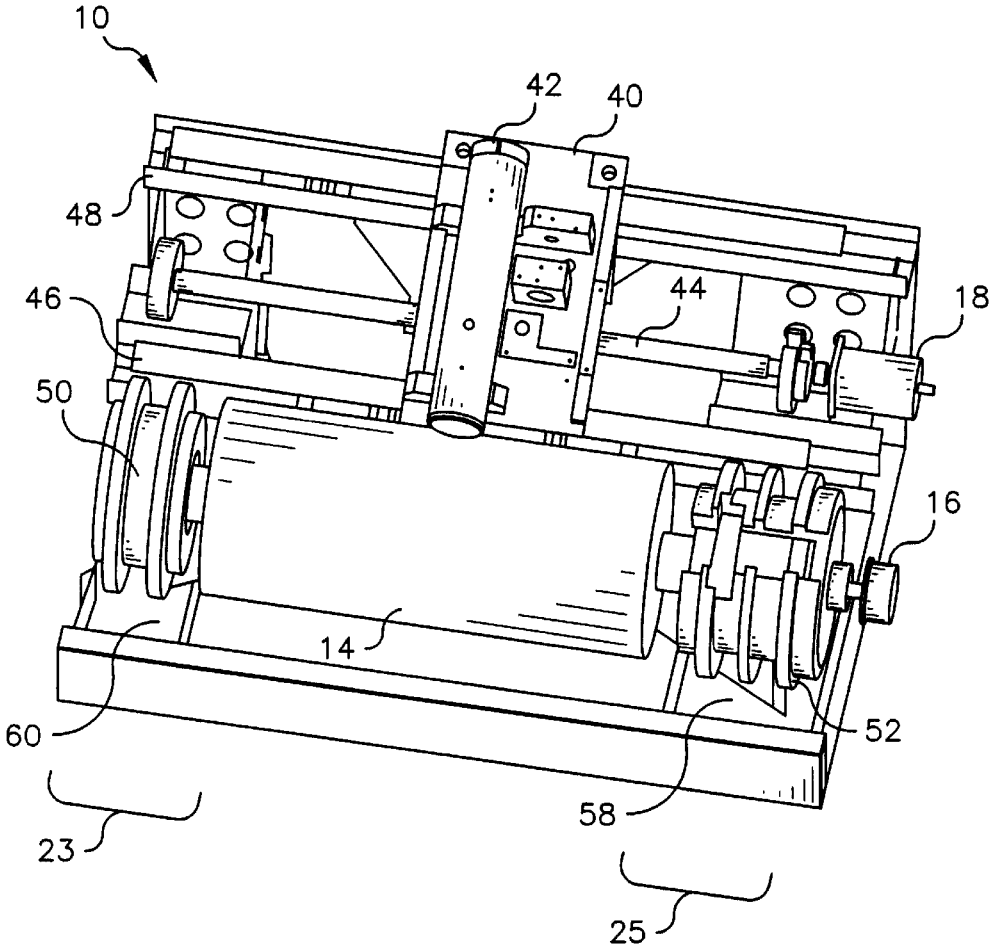
FIG. 3 is a perspective view of a print engine chassis, assembled with an imaging drum, printhead translation assembly, and motors, for writing from right to left.

Referring to FIG. 3, there is shown a print engine 10 optimized for writing from right to left. Print engine 10 has an imaging drum 14, driven by a drum motor 16. Drum motor 14 is mounted to rotate within a left hub end 50 and a right hub end 52 that support drum bearings, not shown. A translation motor 18 drives a printhead translation assembly 40 containing a printhead 42 by means of a lead screw 44. A front guide rail 46 and a rear guide rail 48 support printhead translation assembly 40 over its course of travel from left to right as viewed in FIG. 3. In this embodiment, sidewall 25 is thicker than sidewall 23 in order to accommodate drum motor 16 and translation motor 18.

Referring again to FIGS. 2 and 3, it can be seen that the design of sheet metal frame 12 allows a flexible arrangement of components for print engine 10. For example, relative widths of left side cavity 60 and right side cavity 58 can be reversed to reverse the arrangement of drum motor 16 and hub ends 50 and 52. Print engine 10 can thereby be modified to optimize a writing direction, such as by reversing the path traveled by translation assembly 40.

Figure 4:
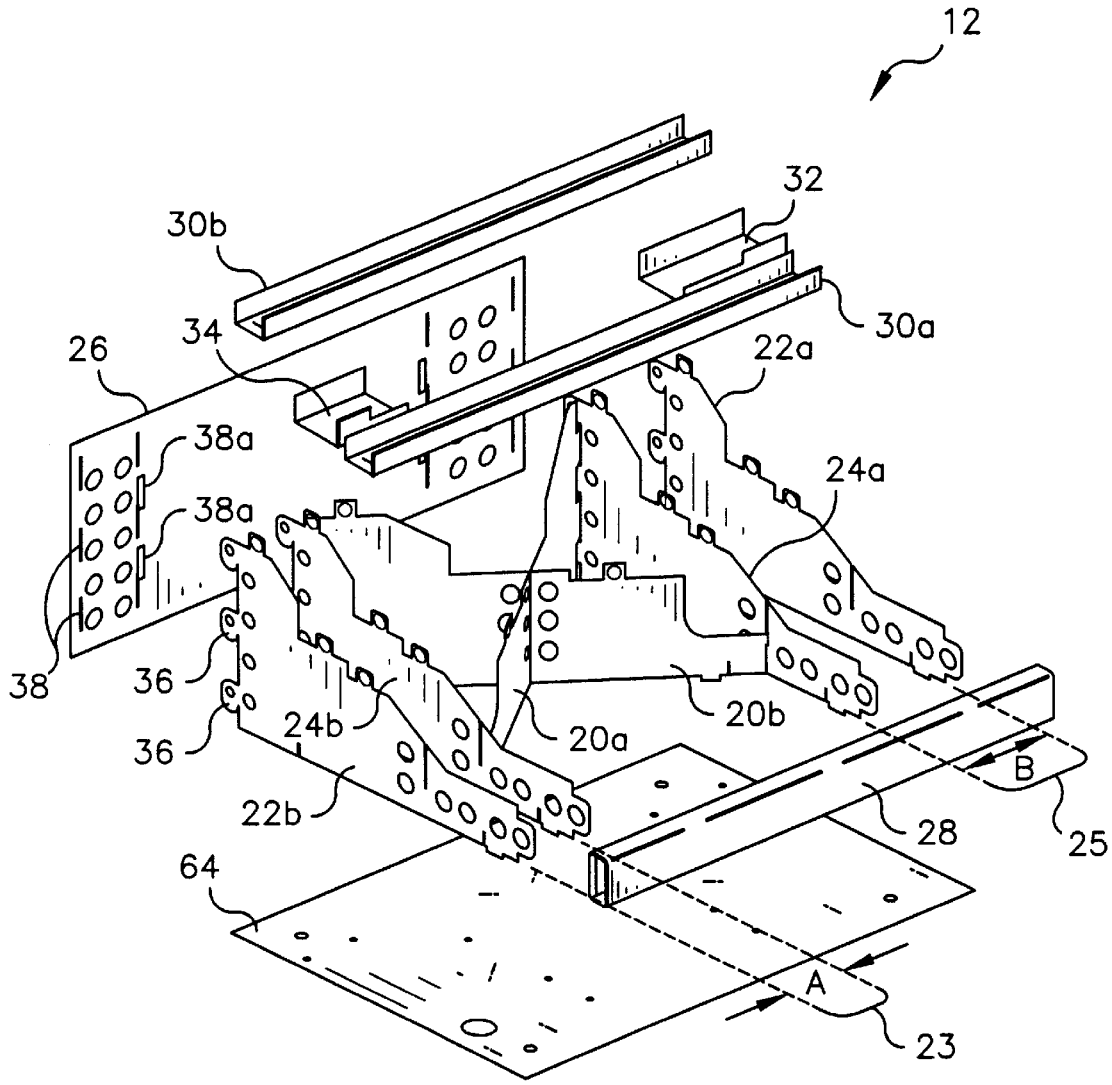
FIG. 4 is an exploded, perspective view of a sheet metal frame for a print engine chassis assembled without fasteners, optimized for writing from right to left.

FIG. 4 shows the arrangement of sheet metal frame 12 that serves as a print engine chassis skeletal structure for a print engine that writes from right to left. In FIG. 4, the relative widths of sidewalls 23 and 25, is reversed from the relative width arrangement shown in FIG. 2.

The arrangement of sheet metal frame 12 in FIG. 4 can be configured by a rearrangement of components shown in FIG. 2. Rear wall 26 and base 64 are reversed and cross-struts 32 and 34 are re-positioned to suit the differing widths of sidewalls 23 and 25 in FIG. 4.

While the invention has been described with particular reference to its preferred embodiments, it will be understood by those skilled in the art that various changes may be made and equivalents may be substituted for elements of the preferred embodiments without departing from the invention. For example, sheet metal could be replaced at selective locations in the print engine chassis by rigid plastic members. A variety of filler materials could be used to fill both the left sidewall 23 and the right sidewall to provide additional rigidity.

PARTS LIST

10. Print engine
12. Sheet metal frame

14. Imaging drum
16. Drum motor
18. Translation motor
20*a*. Cross-brace
20*b*. Cross-brace
22*a*. Outer wall
22*b*. Outer wall
23. Sidewall
24*a*. Interior wall
24*b*. Interior wall
25. Sidewall
26. Rear wall
28. Front member
30*a*. Full-length cross-strut
30*b*. Full-length cross-strut
32. Wide wall cross-strut
34. Narrow wall cross-strut
36. Tab
38. Slot
38*a*. Cross-brace slots
40. Translation assembly
42. Printhead
44. Lead screw
46. Front guide rail
48. Rear guide rail
50. Left hub end
52. Right hub end
58. Right side cavity
60. Left side cavity
64. Base

What is claimed is:

1. A print engine chassis for supporting an imaging drum, an imaging drum motor mounted to a first end of said imaging drum, and a printhead translation assembly and translation motor, said chassis comprising:

a sheet metal frame comprising a plurality of interlocking rigid members;

wherein said interlocking rigid members form a first sidewall having a first thickness for supporting a first hub containing said imaging drum motor and a second sidewall having a second thickness for supporting a second hub mounted to a second end of said imaging drum;

wherein said first and second sidewalls are disposed on opposite ends of said imaging drum;

wherein said thickness of said first sidewall is greater than said thickness of said second sidewall;

wherein said interlocking rigid members are fitted together using a plurality of slots;

wherein said thickness of said sidewalls are adjustable such that said second sidewall thickness is greater than said first sidewall thickness when said imaging drum motor is disposed to be supported by said second sidewall, wherein said printhead translation assembly writes information in a first direction when said thickness of said first sidewall is greater than said thickness of said second sidewall; and wherein said printhead translator assembly writes information in a second direction when said thickness of said second sidewall is greater than said thickness of said first sidewall.

2. A print engine chassis according to claim 1 wherein said sheet metal frame further comprises cross-brace members, wherein said cross-brace members are held in place by slots.

3. A print engine chassis according to claim 2 wherein filler material is added to said first sidewall and said second sidewall to lock said first hub and said second hub in place, and lock said cross-brace members in place.

4. A print engine chassis according to claim 1 wherein said printhead translation assembly writes information in a first direction when said thickness of said first sidewall is greater than said thickness of said second wall.

* * * * *